United States Patent [19]

Holce

[11] 4,210,888

[45] Jul. 1, 1980

[54] MAGNETICALLY OPERATED PROXIMITY SWITCH

[76] Inventor: Thomas J. Holce, 10905 SW. 5th #250, Beaverton, Oreg. 97005

[21] Appl. No.: 926,440

[22] Filed: Jul. 20, 1978

[51] Int. Cl.[2] ..... H01H 36/00

[52] U.S. Cl. ..... 335/207; 335/153; 335/205

[58] Field of Search ..... 335/153, 207, 206, 205

[56] References Cited

U.S. PATENT DOCUMENTS

| | | | |
|---|---|---|---|
| 2,912,540 | 11/1959 | Sawicki | 335/207 |
| 3,222,758 | 12/1965 | Marks | 335/153 |
| 3,243,544 | 3/1966 | Mayer | 335/153 |
| 3,252,057 | 5/1966 | Hoeppel | 335/153 |
| 3,260,821 | 7/1966 | Yokoo | 335/207 |
| 3,668,579 | 6/1972 | Harman | 335/207 |
| 3,806,852 | 4/1974 | Suska | 335/205 |
| 3,967,224 | 6/1976 | Seeley | 335/153 |

*Primary Examiner*—Harold Broome
*Attorney, Agent, or Firm*—Chernoff & Vilhauer

[57] ABSTRACT

A magnetically operated proximity switch for use in physical security monitoring systems, machinery control systems, and the like, comprising a magnetic reed switch having permanent magnet biasing means associated therewith for controlling the sensitivity of the switch to the proximity of an external magnetic field. The reed switch is enclosed in an elongate glass capsule and the magnet of the biasing means is attached to the capsule with its axis of polarity parallel to the reed of the reed switch by means of either a slidable carrier or heat shrinkable tubing. The means of attachment of the biasing magnet to the reed switch capsule allows adjustment of the position of the biasing magnet to control sensitivity of the reed switch. Protective mounting means is provided for attaching the switch and biasing magnet to an object.

13 Claims, 8 Drawing Figures

FIG. 2
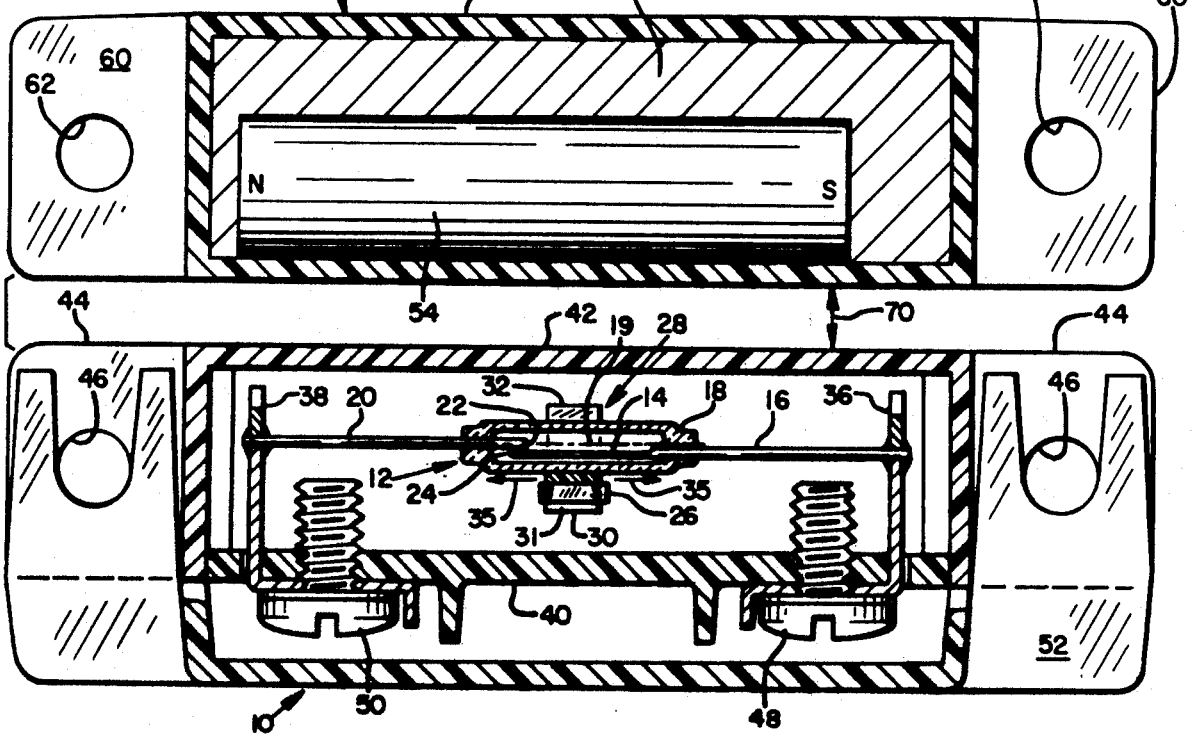
FIG. 3
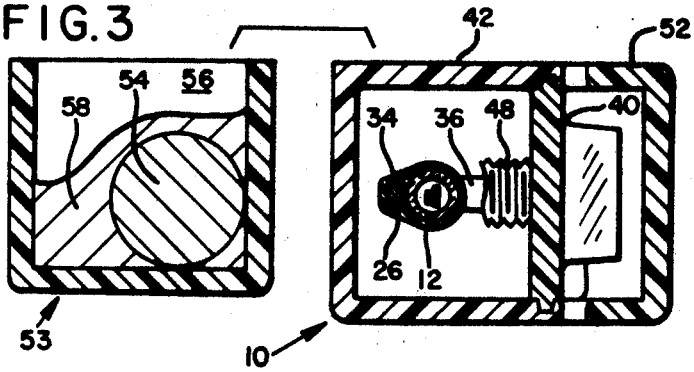
FIG. 4
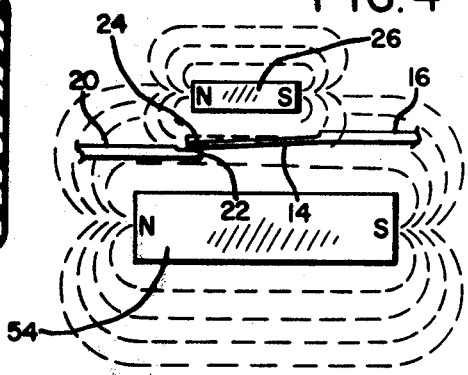
FIG. 1
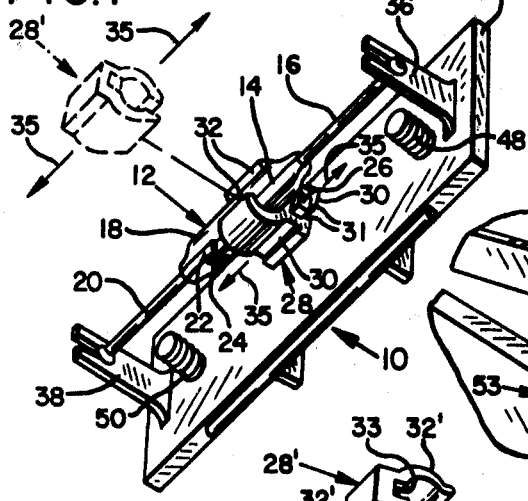
FIG. 5
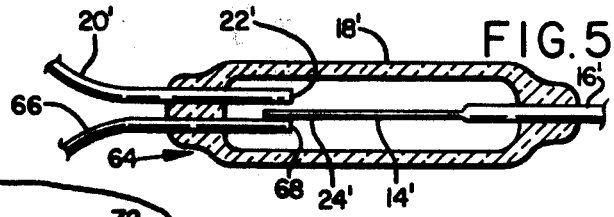
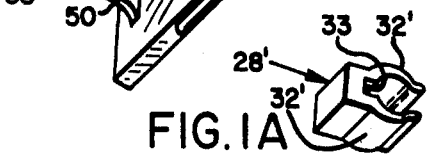
FIG. 1A
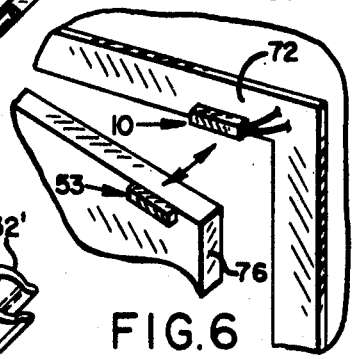
FIG. 6
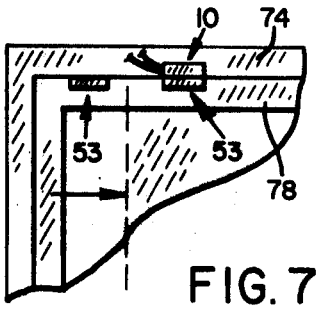
FIG. 7

MAGNETICALLY OPERATED PROXIMITY SWITCH

BACKGROUND OF THE INVENTION

This invention relates to improvements in magnetically actuated reed switches, and particularly to those using permanent magnet biasing for adjusting the sensitivity of a reed switch to changes in magnetic flux density.

A reed switch comprises a tubular glass envelope containing electrical contacts attached to magnetic material, that is, material which becomes magnetized in the presence of a magnetic field, at least one such contact being located at a movable end of a flexible elongate blade, or "reed", of magnetic material. Such a reed switch is operated by increasing the magnetic flux density in the vicinity of the magnetic portions of the switch, thereby magnetizing those portions, which causes the reed to be drawn to another magnetic element of the switch. When the magnetic flux density is reduced, the reed is released and the reed switch resumes its normal condition. In the various forms of reed switches the electrical contacts may move under the influence of a magnetic field either to complete or interrupt a circuit as a single-pole-single-throw switch, or the reed-carried contact may move from a closed position with respect to one fixed contact to a closed position with respect to another fixed contact as a single-pole-double-throw switch.

In security systems magnetic reed switches are often used in conjunction with an actuating permanent magnet which, when close enough to the reed switch, actuates the switch. For example, a switch and its associated electrical conductors, leading to a monitoring control unit and alarm device, may be mounted in or on the frame surrounding a doorway or window opening, with the actuating magnet located in or on the door or window itself, so that location of the door or window in a predetermined position actuates the reed switch, and movement from that position releases the reed switch, producing a signal received by the monitoring device. However, the sensitivity of a reed switch to such actuation is limited, so such an application requires the use of either a strong actuating magnet, or an installation providing a very small gap between the actuating magnet and the sensing reed switch. Moreover, careful alignment of the switch and the actuating magnet is required.

More particularly, in environments containing magnetic materials such as steel fire doors, low sensitivity of the reed switch has caused the reliability of such security switches to be less than desired, since a slight movement of the actuating magnet could allow the magnetically held components to be released. For example, such switches installed to monitor a door can produce false alarms if wind gusts cause the door to shift slightly, and switches monitoring overhead or sliding doors can produce an erroneous indication of the position of such doors because of minor misalignment in their tracks.

The use of larger actuating magnets mounted on doors and windows allows these insensitive reed switches to remain actuated despite small movements of doors and windows, reducing the number of false alarms, but making such a magnetic switch more easily detected and located by a magnetometer, and thus less secure from tampering. Additionally, the material used in producing the actuating magnets is not inexpensive, and larger magnets appreciably increase the cost of the devices. Also, the smaller the actuating magnet, the more easily its installation may be concealed.

As well as in security systems, magnetically actuated switches are useful for machine control applications, and the low sensitivity of conventional reed switches is also often of concern in that environment.

One means of increasing the sensitivity of such a reed switch is to place a permanent magnet near the switch to bias the reed by providing part of the magnetic flux density necessary for actuation. Permanent magnet bias means for controlling the sensitivity of reed switches have previously been disclosed, for example by varying the distance or angular relationship between the magnet and the longitudinal axis of the reed of the switch, as shown in Nicholls U.S. Pat. No. 3,974,469, and by varying the location of the reed along an imaginary axis parallel to the axis of polarity of the biasing magnet, as shown by Tann U.S. Pat. No. 3,305,805. However, the device of the Nicholls patent requires either a threaded hole in the biasing magnet in order to vary its distance, or a disc-shaped rotatable magnet and socket to vary its angular relationship, both of which are somewhat expensive and complicated means of attachment, and Tann shows no apparatus for holding the axis of polarity of a biasing magnet parallel to the reed of a reed switch. Also, while Tann shows a means of adjustment of the position of a reed switch relative to a magnet, only discrete, not continuous, variation of position is provided. Accordingly, there is a need for a reed switch having an inexpensive and simple means of attaching a small biasing permanent magnet to the reed switch in a continuously adjustable position parallel thereto for producing a desired level of sensitivity.

SUMMARY OF THE INVENTION

The aforementioned problems with the adaptation of prior art magnetically-actuated switches to security systems of proximity-sensing applications are overcome by the present invention, which provides a novel reed switch of increased sensitivity which is particularly useful for security system monitoring switches, and is also applicable to other types of proximity sensing.

According to the present invention a reed switch is suspended between supporting connection points, and a relatively small biasing permanent magnet, which may be manufactured for example, of alnico V or alnico VIII, is mounted with its axis of polarity substantially parallel to the reed of the reed switch. The biasing magnet is movable parallel to the axis of the reed, at a fixed distance therefrom, to provide an adjustable biasing field which varies the sensitivity of the reed switch to the field of an actuating magnet. In a preferred embodiment, the biasing magnet is held close to the reed switch by a small plastic clip having legs which grip around the small permanent magnet and partially encircle and grip the glass capsule of the reed switch. Alternatively, the biasing magnet may be held alongside the capsule by heat shrinkable tubing encircling the magnet and capsule. This small biasing magnet predisposes the reed of the switch to move in response to the field of the larger actuating magnet when the actuating magnet is at a distance greater than that possible without the biasing magnet. For adjustment the biasing magnet may be slid along the capsule of the reed switch to the appropriate position to provide a desired sensitivity. Once the sensitivity has been adjusted the biasing magnet may be fixed in place by an appropriate adhesive.

In a common application the switch is mounted in the frame of a doorway or window, while the actuating magnet is mounted in the edge of the door or the window sash, aligned with its polarity parallel to that of the biasing magnet. Final adjustment of the response of the switch to movement of the door or window may be made by varying the placement of the actuating magnet relative to the reed switch.

The higher sensitivity of the switch of the invention allows the use of a smaller actuating magnet, which is less expensive to produce and more difficult to detect and locate. At the same time, the greater sensitivity of the switch with the biasing magnet properly adjusted allows the gap between the switch itself and the actuating magnet mounted on the door or window to be sufficiently large that vibrations caused by the wind or machinery, etc. do not set off false alarm indications.

It is therefore a principal objective of this invention to provide a magnetically actuated switch of improved, adjustable sensitivity.

It is a further objective of this invention to provide a magnetically operated switch for use in physical security monitoring systems which is not easily detected by magnetometers.

It is yet a further objective of this invention to provide an inexpensively produced magnetically actuated switch for use in security control systems.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of the interior of a preferred embodiment of a switch according to the invention.

FIG. 1A is a perspective view of an alternative embodiment of a portion of the switch shown in FIG. 1.

FIG. 2 is an enlarged sectional view of the preferred embodiment shown in FIG. 1, including a housing and accompanied by an actuating magnet.

FIG. 3 is a sectional end view of the switch shown in FIG. 2.

FIG. 4 is a schematic diagram of the switch shown in FIG. 2.

FIG. 5 is a detail of a reed switch which may be used in the invention.

FIG. 6 is a view of a typical installation of a switch embodying the invention.

FIG. 7 is a view of another typical installation of a switch embodying the invention.

DETAILED DESCRIPTION OF THE INVENTION

Referring to FIG. 1, showing a preferred embodiment 10 of the switch of the present invention, it can be seen that the switch includes a magnetically actuated reed switch 12 having a flexible magnetic reed 14 connected to a first conductor 16. The reed is enveloped in a cylindrical glass capsule 18 and is oriented substantially parallel to the longitudinal axis 19 thereof. The first conductor 16 extends outward through one end of the capsule, and at the other end of the glass capsule a second conductor 20 extends through the glass capsule and terminates in a magnetic fixed contact 22 inside the capsule. A highly permeable metal of low retentivity, such as a 50% nickel, 50% iron alloy, has been found to be a suitable material for the magnetic reed and magnetic fixed contact. Other versions of the reed switch may include a plurality of magnetic reeds having contacts movable relative to one another. A movable contact 24 is so located on the movable magnetic reed 14 that the contacts 22 and 24 may be brought into mutual contact by a slight flexion of the reed in response to a magnetic field of appropriate strength.

A small, preferably elongate, biasing magnet 26 is held adjacent the capsule with its axis of polarity, that is, the imaginary line which runs through the two poles of the magnet, substantially parallel to the longitudinal axis 19 of the capusle 18 and the reed 14, by means of a plastic carrier 28. In the preferred embodiment of the invention, the carrier 28 is a plastic clip which may be a short section of an extruded plastic form having a cross-section approximating the shape of the letter H. A pair of lower legs 30, which have small inwardly facing retaining lips 31 on their extremities, fit slidingly around the biasing magnet 26, holding it in place, and a pair of curved upper legs 32 partially encircle and resiliently grip the glass capsule 18 of the reed switch 12. The upper legs 32 hold the carrier 28 firmly yet slidably attached to the glass capsule 18, allowing the carrier 28 and the biasing magnet 26 to be moved longitudinally relative thereto as indicated by arrows 35.

Alternatively a carrier in the form of a plastic clip 28', having a cross-section similar to the letter "C" and including a recess 33 in which a biasing magnet 26 slidingly fits, may be used to hold the biasing magnet adjacent to the capsule of the reed switch, as shown in FIGS. 1 and 1A.

As a third alternative a short section of plastic heat-shrink tubing 34 may be placed around the capsule 18 and the biasing magnet 26 and shrunk by heat to hold the magnet in place, as shown in FIG. 3. Thereafter the position of the biasing magnet along the capsule may be adjusted to provide the desired degree of sensitivity.

Each of these methods of attachment allows the location of the biasing magnet to be adjusted after attachment to the reed switch capsule and thereafter to be rigidly fixed in place. The plastic clips 28 and 28' can be inexpensively formed as extrusions and then cut to the desired length, and plastic heat-shrink tubing is a commonly available item; thus the invention provides a low-cost means of providing magnetic biasing for a reed switch.

Referring to FIG. 2 it can be seen that the first conductor 16 is connected to a first terminal post 36, and the second conductor 20 is connected to a second terminal post 38. The terminal posts 36 and 38 are mounted on a base plate 40, and thereby provide support for the reed switch 12 through the first and second conductors.

The base plate 40 is located within a housing 42 having a pair of mounting lugs 44 which define mounting holes 46. A binding post screw 48 corresponds to the first terminal post 36 and a binding post screw 50 corresponds to the second terminal post 38 for making electrical conductor connections to the switch. A protective cover 52 protects the binding post screws and any conductors attached from the switch to an alarm system control unit, thereby preventing accidental disconnection or shorting.

An actuating unit 53, containing an actuating magnet 54 of larger size and greater strength than the biasing magnet 26, is adhesively fixed in a protective housing 56 by means of an epoxy or other potting material 58. The actuating unit 53 is mounted on one of the objects whose relative motion is being monitored, with the actuating magnet 54 oriented in parallel polarity with the biasing magnet 26, as is shown by the indications of north and south magnetic poles in FIG. 2. Lugs 60, defining mounting screw holes 62, similar to those of the switch housing, are provided on the protective housing 56. Referring to FIG. 4, the switch of the invention is shown in a simplified schematic view, in the magnetically actuated state. The combined magnetic fields of the actuating magnet 54 and the biasing magnet 26 act to produce sufficient induced magnetism in the reed 14 and the fixed magnetic contact 22 so that mutual attraction therebetween causes the reed to bend elastically from its relaxed position, shown in broken line, to the position shown in solid line. Thus the reed-carried contact 24 and the magnetic fixed contact 22 are brought together, closing the electrical circuit.

The reed switch 12 may be of the type having contacts which are normally open, or of the type having contacts which are normally closed. Additionally, the single-pole-double-throw type of reed switch 64 illustrated in FIG. 5, may be used. In this case, a magnetic reed 14' is connected to a first conductor 16', a second conductor 20' is connected to a fixed magnetic contact 22' forming one circuit branch, and a third conductor 66 is connected to a fixed non-magnetic contact 68 forming another circuit branch. The magnetic reed is spring biased by its own elasticity to cause contact of a reed-carried contact 24' with the non-magnetic contact 68, and a sufficient magnetic field surrounding the switch causes mutual attraction between the reed and the fixed magnetic contact 22', thereby moving the reed and shifting the electrical circuit to conductor 20'. As with the earlier-described reed switch 12, the reed and contacts are encapsulated in a glass capsule 18'. A connecting post corresponding to the third conductor 66 is provided when the single-pole-double-throw type switch is used.

In a security monitoring application, the switch of the invention is usually mounted on the frame of a doorway or window. The actuating unit 53 is then mounted upon the door or the window sash, aligned with the switch as illustrated in FIGS. 2, 6 and 7. In this position the magnetic fields of the actuating magnet 54 and the biasing magnet 26 are complimentary, causing the reed switch to operate and holding the reed switch in its actuated state. In the case of a normally-open-contact reed switch, the contacts would then be closed. Separation of the actuating magnet 54 from the switch by opening the door or windows allows the properly adjusted reed switch to drop out of its actuated state, opening a control circuit in the case of a reed switch having normally-open contacts, or completing a control circuit in the case of a reed switch having normally-closed contacts.

With the switch of the invention, the gap 70 between the switch and actuating magnet 54 in a given installation may be made greater than with the same reed switch and same size actuating magnet in the absence of the biasing magnet 26. The sensitivity of the switch may be adjusted by moving the biasing magnet 26 from a position near the fixed end of the reed 14 toward the movable contact-carrying end of the reed 14 until the presence of the actuating magnet, properly oriented, within a desired actuation distance causes actuation of the reed switch. Care must be taken, however, that the biasing magnet 26 is not moved to a position where it alone causes too great a field at the contact end of the reed 14, for this may result in the reed switch, once actuated, remaining in the actuated position under the influence of the biasing magnet 26 alone. This is possible because the magnetic attraction between the reed and the fixed magnetic contact increases as they approach each other more closely. Although the biasing magnet 26 is much smaller and much weaker than the actuating magnet 54, it is so close to the elements of the reed switch that its effect alone, if it is improperly positioned, is sufficient to cause actuation of the reed switch, or to hold the reed switch, once actuated, in its actuated position.

Therefore, for optimum operation, the biasing magnet 26 is factory adjusted to produce increased, but not maximum, sensitivity of the reed switch to the approach of the actuating magnet. After the location of the biasing magnet has been adjusted during manufacture of the switch unit it may be adhesively secured, for example by the use of a fast acting glue such as the adhesive sold under the trademark EASTMAN 911 by the Eastman Kodak Company of Rochester, New York, resulting in a factory-adjusted, high-sensitivity magnetically actuated switch.

In the preferred embodiment of the invention, the carrier 28 is oriented as shown in FIG. 2, with the biasing magnet between the reed switch and the base plate, and the actuating magnet 54 approaching the reed switch from the opposite side. This is not the most sensitive arrangement, but is used because it protects the carrier 28 from dislocation during assembly of the switch.

The angular orientation of the reed switch about the axis of the conductors 16 and 20 also affects the sensitivity of the reed switch to the field of the actuating magnet. However, because a problem of the contacts remaining in the actuated position may be produced if maximum sensitivity of the switch is used, the sensitivity is set at less than the maximum. Any variation in sensitivity resulting from the angular orientation of the reed switch may be easily accommodated by longitudinal movement of the biasing magnet along the capsule 18, and is therefore negligible in adjusting the magnetically actuated switch. As a result, the switch may be assembled by simply insuring that the polarity of the biasing magnet is parallel to that of the actuating magnet, and adjusting the position of the biasing magnet to provide sensitivity which is near the maximum without being so great that the reed switch remains in the actuated position after removal of the actuating magnet.

Referring to FIGS. 6 and 7, it can be seen that in typical installations the magnetically actuated switch may be installed in a doorway frame 72 or window casement 74 and the actuating magnet may be mounted upon the door 76 or window sash 78. Because of the greater sensitivity of the switch of the invention the gap 70 between the switch and actuating magnet may be greater than when the biasing magnet 26 is not used, and the switch will not so readily become unactuated in response to small changes in the actuating magnetic field. This allows the switch to be used in applications where the gap between the door frame and door is greater than the actuation gap of a magnetic switch without the biasing magnet 26, or in applications where the door or window being monitored may be caused to vibrate by gusts of wind, etc.

The terms and expressions which have been employed in the foregoing specification are used therein as terms of description and not of limitation, and there is no intention in the use of such terms and expressions of excluding equivalents of the features shown and described or portions thereof, is being recognized that the scope of the invention is defined and limited only by the claims which follow.

What is claimed is:

1. A proximity switch device for controlling an electrical circuit in response to the presence of a magnetic field of predetermined strength, said proximity switch device comprising:

(a) a reed switch having a pair of magnetic contacts contained within an elongate capsule having a longitudinal axis, said contacts being movable relative to one another from an unactuated state to a magnetically actuated state in response to the presence of a magnetic field of at least a predetermined minimum flux density;

(b) permanent magnet means, having an axis of polarity, associated with said capsule for providing a predetermined portion of said predetermined magnetic flux density, said predetermined portion being less than the minimum required to retain said contacts in said magnetically actuated state; and (c) magnet carrier means resiliently gripping said capsule for adjustably positioning said permanent magnet means relative to said reed switch so as to provide said predetermined portion of said predetermined magnetic field strength, said magnet carrier means including means for holding said permanent magnet means such that said axis of polarity is parallel to said longitudinal axis and said permanent magnet means is a predetermined distance from said longitudinal axis, and said magnet carrier means permitting said magnet to be moved in a longitudinal direction relative to said capsule while maintaining said predetermined distance between said permanent magnet means and said longitudinal axis.

2. The proximity switch device of claim 1 wherein said magnet carrier means comprises a clip having a cross-section approximating the form of the letter "H", said clip having a pair of upper legs arranged for fitting around and resiliently and slidably gripping said capsule, and a pair of lower legs for holding said permanent magnet means.

3. The proximity switch device of claim 1 wherein said magnet carrier means comprises a clip having a cross-section approximating the shape of the letter "C", and includes a recess for holding said permanent magnet means and a pair of arms arranged for fitting around and resiliently and slidably gripping said capsule.

4. The proximity switch device of claim 1 wherein said magnet carrier means comprises a clip composed of a resilient plastic material.

5. The proximity switch device of claim 1 wherein said magnet carrier means is adhesively fixed in a predetermined position.

6. The proximity switch device of claim 1 wherein said magnet carrier means comprises a length of heat-shrink tubing shrunk around both said elongate capsule and said permanent magnet means, with said permanent magnet means adjacent to said capsule.

7. The proximity switch device of claim 1 further comprising actuating means for providing an actuating magnetic field surrounding said reed switch for reinforcing the magnetic field of said permanent magnet means and actuating said switch device.

8. The proximity switch device of claim 7 wherein said reed switch is of the normally-closed-circuit type, said electrical circuit being open when said reed switch is in said magnetically actuated state.

9. The proximity switch device of claim 7 wherein said reed switch is of the normally-open-circuit type, said electrical circuit being closed when said switch is in said magnetically actuated state.

10. The proximity switch device of claim 7 wherein said reed switch is of the single-pole-double-throw type, said switch being normally in a closed-circuit state for a first branch and an open-circuit state for a second branch, said contacts being moved to open said first branch circuit and close said second branch circuit when said reed switch is in said magnetically actuated state.

11. The proximity switch device of claim 8 wherein said reed switch, said biasing magnet, and said carrier are enclosed in a switch housing having means for attaching said switch housing to an object, and said actuating means is enclosed in a protective housing having means for attaching said protective housing to a second object.

12. A method of actuating a proximity switch device comprising a magnetic reed switch, comprising the steps of:

(a) providing a switch unit comprising a reed switch having a pair of magnetic contacts, at least one of said pair of contacts having a longitudinal axis and being movable relative to the other from an unactuated state to a magnetically actuated state in response to the presence of a magnetic field of at least a predetermined flux density;

(b) adjustably attaching a small permanent magnet, having an axis of polarity, adjacent to said reed switch such that said axis of polarity is parallel to said longitudinal axis;

(c) adjusting the position of said small permanent magnet relative to said reed switch to a position wherein said small permanent magnet subjects said reed switch to a magnetic field having a flux density barely insufficient to retain said reed switch in a magnetically actuated condition; and (d) moving an actuating unit comprising a permanent magnet toward said reed switch with said permanent magnet oriented so as to provide additional magnetic flux which is additive to the magnetic field which is additive to the magnetic field of said small permanent magnet surrounding said reed switch until the magnetic field of said actuating magnet provides additional flux density sufficient to actuate said magnetic reed switch.

13. The method of claim 12, wherein step "c" consists of moving said small permanent magnet parallel to said longitudinal axis, at a predetermined distance therefrom.

* * * * *

UNITED STATES PATENT AND TRADEMARK OFFICE

CERTIFICATE OF CORRECTION

PATENT NO. : 4,210,888

DATED : July 1, 1980

INVENTOR(S) : Thomas J. Holce

It is certified that error appears in the above-identified patent and that said Letters Patent are hereby corrected as shown below:

| | |
|---|---|
| Col. 2, Line 39 | Change "of" to --or--. |
| Col. 7, Line 2 | Change "is" to --it--. |
| Col. 8, Line 53 | Delete "which is additive to the magnetic field". |

Signed and Sealed this

*Thirtieth* Day of *December 1980*

[SEAL]

*Attest:*

SIDNEY A. DIAMOND

*Attesting Officer*

*Commissioner of Patents and Trademarks*